US008297613B2

(12) United States Patent
Katayama

(10) Patent No.: US 8,297,613 B2
(45) Date of Patent: Oct. 30, 2012

(54) SHEET FEEDING APPARATUS AND IMAGE FORMING APPARATUS

(75) Inventor: Hiromasa Katayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/962,287

(22) Filed: Dec. 7, 2010

(65) Prior Publication Data

US 2011/0140356 A1 Jun. 16, 2011

(30) Foreign Application Priority Data

Dec. 10, 2009 (JP) ..... 2009-281004

(51) Int. Cl.
*B65H 1/08* (2006.01)

(52) U.S. Cl. ..... 271/147; 271/152; 271/153; 399/23

(58) Field of Classification Search ..... 271/147, 271/152–156; 399/393, 9, 16, 23, 381, 389, 399/391

See application file for complete search history.

(56) References Cited

U.S. PATENT DOCUMENTS 7,454,145 B2 * 11/2008 Weaver et al. ..... 399/9

FOREIGN PATENT DOCUMENTS

JP 02-108883 U 8/1990
JP 06-282134 A 10/1994

* cited by examiner

*Primary Examiner* — Michael McCullough
(74) *Attorney, Agent, or Firm* — Canon USA Inc. IP Division

(57) ABSTRACT

A packing material for distribution is formed in such a shape that, when the packing material attached in a deck unit fails to be removed, a control unit determines that no sheet is present on a tray based on detection signals from a sheet surface detection sensor and a sheet presence detection sensor. When a user checks the deck unit when the absence of sheets is displayed, the user can notice a failure to remove the packing material, thus preventing damage to a sheet feeding apparatus caused by the failure to remove the packing material for distribution.

9 Claims, 11 Drawing Sheets

SHEET FEEDING APPARATUS AND IMAGE FORMING APPARATUS

BACKGROUND OF THE INVENTION

1. Field of the Invention

The present invention relates to a sheet feeding apparatus used for an image forming apparatus such as a copying machine and a printer.

2. Description of the Related Art

An image forming apparatus which forms an image on a sheet is generally provided with a sheet feeding apparatus for continuously feeding sheets to an image forming unit included in the image forming apparatus. The sheet feeding apparatus includes a motor-driven elevatable tray for stacking sheets, and side regulating members and a trailing edge regulating member for positioning sheets on the tray. The sheet feeding apparatus also includes a pickup roller for feeding an uppermost sheet stacked on the tray and a separation unit for separating from other sheets the sheet fed from the pickup roller.

To maintain the uppermost sheet stacked on the tray to an appropriate position for feeding with the pickup roller, the sheet feeding apparatus also includes a sheet surface detection unit for detecting the position of the sheet top surface. The sheet feeding apparatus also includes a control unit for controlling a drive unit such as a motor to set the uppermost sheet to vertically move the tray so that the uppermost sheet comes to an appropriate position in response to the sheet surface detection by the sheet surface detection unit. In general, the sheet surface detection unit includes a sensor lever rotatably disposed above the tray and a sensor (such as a photo-interrupter) which turns on or off when the sensor lever is pressed by the sheet top surface and then rotated.

In addition to the sheet surface detection unit, the sheet feeding apparatus also includes above the tray a sheet presence detection unit for detecting the presence of a sheet stacked on the tray. The sheet presence detection unit has a similar configuration to the sheet surface detection unit. When the sheet runs out, the sensor lever falls into an opening provided at a position on the tray corresponding to the sensor lever, thus the sheet presence detection unit detecting the absence of sheet.

Generally, an elevating mechanism for vertically moving the tray supports the tray with a wire. The motor winds and rewinds the wire to vertically move the tray, respectively. At the time of shipment and delivery to a user, such a sheet feeding apparatus is packed together with an image forming apparatus before transportation. In this case, the tray in the sheet feeding apparatus is suspended by a wire and, therefore, is unstable.

Conventionally, the tray is fixed by padding packing material such as corrugated paper to prevent damage to the tray. Japanese Patent Application Laid-Open No. 06-282134 and Japanese Patent Application Laid-Open No. 02-108883 discuss such a technique.

For example, when the power of the image forming apparatus is turned on with the packing material failed to be removed from the sheet feeding apparatus, the motor of the elevating mechanism starts but the tray cannot be vertically moved since it is fixed by the packing material. Therefore, excessive load is applied to the elevating mechanism, possibly causing damage to gears for transmitting the driving force from the motor. Problems other than the above-mentioned ones will be described below with reference to an example of the conventional packing material.

As illustrated in FIG. 10A, a feeding deck (component of the sheet feeding apparatus) includes a tray 51, side regulating members 65*a* and 65*b* for regulating the side ends of sheets stacked on the tray 51, and a trailing edge regulating member 66 for regulating the trailing edge thereof. The feeding deck also includes a pickup roller 16*a* for feeding the uppermost sheet of the sheets stacked on the tray 51, and a pair of a feeding roller 16*b* and a retarding roller 16*c* for separating from other sheets the sheet fed from the pickup roller 16*a*. To control the vertical motion of the tray 51, the feeding deck also includes the sheet surface detection unit for detecting the top surface position of the stacked sheet and the sheet presence detection unit for detecting the presence of sheet on the tray.

The sheet surface detection unit includes sheet surface detection sensors 53 and 54, which generate respective ON/OFF signals based on the position of the pickup roller 16*a*. A holder 60 which supports the pickup roller 16*a* is provided with the function of a detection lever. The holder 60 has flags formed thereon for causing the sheet surface detection sensors 53 and 54 to generate the ON/OFF signals. Then, the ON/OFF signals of the sheet surface detection sensors 53 and 54 are generated by the flags of the holder 60 in relation to the position of the pickup roller 16*a*. The position of the sheet top surface is detected by the control unit based on the ON/OFF signals. More specifically, when the tray 51 rises, the sheet top surface pushes up the pickup roller 16*a*. When the ON/OFF signals of the sheet surface detection sensors 53 and 54 are generated by the flags, the position of the sheet top surface is detected.

The sheet presence detection unit includes a detection lever 52 and a sheet presence detection sensor 61. When the detection lever 52 falls into an opening (not illustrated) formed on the tray 51, the absence of sheet is detected.

When a conventional packing material 71 having a concaved central part is used, as illustrated in FIG. 10A, when the power of the image forming apparatus is turned on with the packing material 71 failed to be removed, the sheet surface detection sensors 53 and 54 determine that the sheet top surface S is low. Therefore, the elevating mechanism (not illustrated) raises the tray 51, resulting in a state illustrated in FIG. 10B. In this case, before the packing material 71 is detected by the sheet presence detection sensor 61 or the sheet surface detection sensors 53 and 54, a top surface 71*a* of the packing material 71 contacts the detection lever 52 of the sheet presence detection unit, thus causing damage thereto.

When a packing material 72 having a rectangular parallelepiped shape as illustrated in FIG. 11A is used as another conventional packing material, failure to remove the packing material 72 causes the following problems.

When the power of the image forming apparatus is turned on, the sheet surface detection sensors 53 and 54 determine that the position of the sheet S top surface is low. Therefore, the elevating mechanism (not illustrated) raises the tray 51. In this case, the packing material 72 causes the same state as the one where the sheet S is stacked on the tray 51 of the sheet feeding apparatus. Therefore, the control unit incorrectly recognizes the presence of sheets based on the sheet presence detection by the sheet presence detection sensor 61, and performs the sheet feed operation. More specifically, the tray 51 is raised until the top surface of the packing material 72 reaches a predetermined height at which the sheet feed operation by the pickup roller 16*a* is started. When the pickup roller 16*a* performs the sheet feed operation in this state, as illustrated in FIG. 11B, the packing material 72 and the pickup roller 16*a* are in friction, causing such damage as abrasion to the surface of the pickup roller 16*a*.

In recent years, since an increasing number of image forming apparatuses have performed image formation on a large amount of diverse types of sheets, it has become necessary to prepare a number of sheet feeding apparatuses for one image forming apparatus. Accordingly, a failure to remove the packing material is likely to occur.

SUMMARY OF THE INVENTION

The present invention is directed to a sheet feeding apparatus and an image forming apparatus that can prevent a failure to remove a packing material with a simple configuration.

According to an aspect of the present invention, a sheet feeding apparatus includes: a sheet storage unit configured to store sheets, an elevatable tray disposed in the sheet storage unit to supply sheets stacked thereon, a sheet feeding unit configured to feed a sheet stacked on the tray, a sheet surface detection unit configured to output a signal for detecting a top surface position of the sheets stacked on the tray, a sheet presence detection unit configured to output a signal for detecting a presence of a sheet on the tray, a control unit configured to control the tray, and a packing material attached in the sheet storage unit to fix the tray, wherein the packing material is formed in such a shape that, when the packing material is attached in the sheet storage unit, the control unit determines that no sheet is present on the tray based on detection signals from the sheet surface detection unit and the sheet presence detection unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 3:
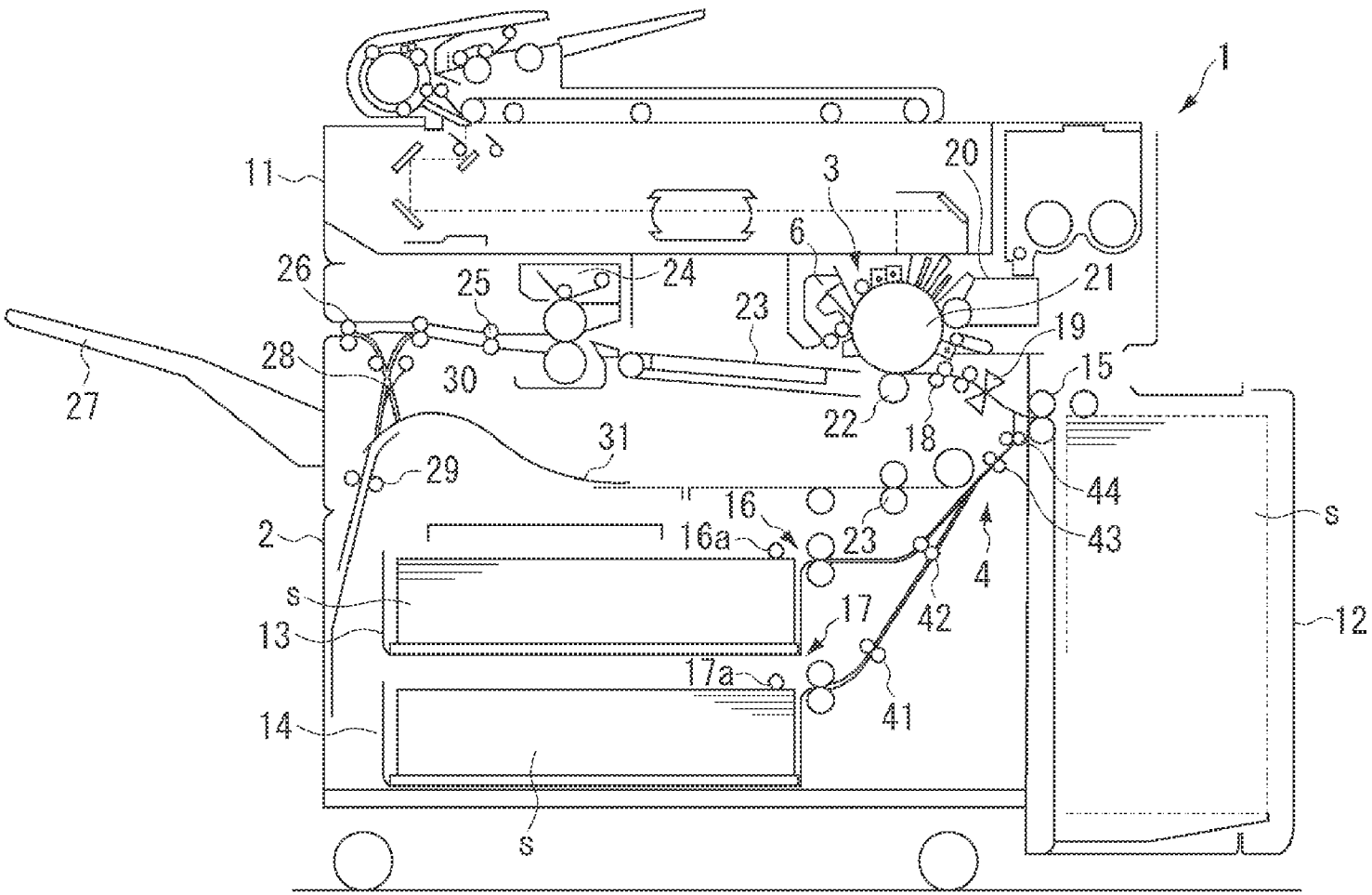
FIG. 3 is a sectional view illustrating an image forming apparatus including the sheet feeding apparatus according to the first exemplary embodiment.

First of all, an overall configuration of a printer, which is an exemplary image forming apparatus including a sheet feeding apparatus according to an exemplary embodiment of the present invention, will be described below with reference to FIG. 3.

A printer 1 includes a printer body 2, a scanner 11 arranged on the top surface of the printer body 2, and a feeding deck 12 that can store a number of sheets S arranged as an option on one side of the printer body 2.

The printer body 2 includes an image forming unit 3 including a photosensitive drum 21 (image bearing member), a developing unit 20 for developing an electrostatic image formed on the photosensitive drum 21 by using toner, and a cleaner unit 6. The printer body 2 also includes sheet feeding apparatuses 16 and 17 employing the retarding/separating method for feeding the sheet S toward under the image forming unit 3, and a sheet conveyance apparatus 4 for conveying the sheet S fed from the sheet feeding apparatuses 16 and 17 to the image forming unit 3.

The feeding deck 16 (sheet feeding apparatus) includes a deck unit 13 for stacking the sheet S, a pickup roller 16*a*, a feeding roller 16*b*, and a retarding roller 16*c*. Likewise, a feeding deck 17 (sheet feeding apparatus) includes a deck unit 14 for stacking the sheet S, a pickup roller 17*a*, a feeding roller 17*b*, and a retarding roller 17*c*. The sheet S picked up by the pickup roller 16*a* is separated from other sheets by a pair of the feeding roller 16*b* and the retarding roller 16*c* and then fed to the sheet conveyance apparatus 4. Likewise, the sheet S picked up by the pickup roller 17*a* is separated from other sheets by a pair of the feeding roller 17*b* and the retarding roller 17*c* and then fed to the sheet conveyance apparatus 4.

The sheet conveyance apparatus 4 includes conveyance rollers 41, 42, 43, and 44, a leading edge detection sensor 19, and a registration roller pair 18 for skew correction. Each of the sheets S fed from the feeding decks 16 and 17 is conveyed by the conveyance rollers 41, 42, 43, and 44, passes through the leading edge detection sensor 19, and then is led to the registration roller pair 18. Further, the printer body 2 is optionally provided with the feeding deck 12, which is a detachable sheet feeding apparatus. The sheet S stacked in the feeding deck 12 passes through the leading edge detection sensor 19 by the sheet feeding apparatus 15 employing the retarding/separating method and then is led to the registration roller pair 18. When the leading edge of the sheet S reaches the leading edge detection sensor 19, a control unit determines timing for starting electrostatic image formation onto the photosensitive drum 21 with laser beams.

After skew of the sheet S is corrected by the registration roller pair 18, the sheet S is fed to a transfer unit including the photosensitive drum 21 and a transfer roller 22 in the image forming unit 3. The transfer unit transfers a toner image preformed on the photosensitive drum 21 onto the sheet S. Since the control unit determines the timing of image formation onto the photosensitive drum 21 based on a result of the sheet S leading edge detection by the leading edge detection sensor 19 as mentioned above, the sheet S and the image are positioned with high precision in the transfer unit. Residual toner on the surface of the photosensitive drum 21, i.e., toner that was not transferred onto the sheet S, is scratched and removed from the surface of the photosensitive drum 21 by the cleaner unit 6. The sheet S having a toner image transferred thereon is fed to a fixing unit 24 by a conveyance belt 23. The fixing unit 24 applies fixing process to fix the transferred toner image onto the sheet surface.

The printer 1 includes two different modes: a double-sided copy mode for making a double-sided copy to the sheet S and a normal copy mode (one-sided copy mode). In the normal copy mode, the sheet S subjected to the fixing process is reversed on a reversing path 28 and then discharged onto an outside discharge tray 27 by a discharge roller pair 26. In the double-sided copy mode, the sheet S is reversed by a switchback roller pair 29 and then fed to a double-sided conveyance path 30. Then, the sheet S is conveyed from the double-sided conveyance path 30 to the registration roller pair 18 again by a re-feeding apparatus 32 for image formation, undergoes the same process as the one-sided copy mode, and then is discharged outside.

Figure 2:
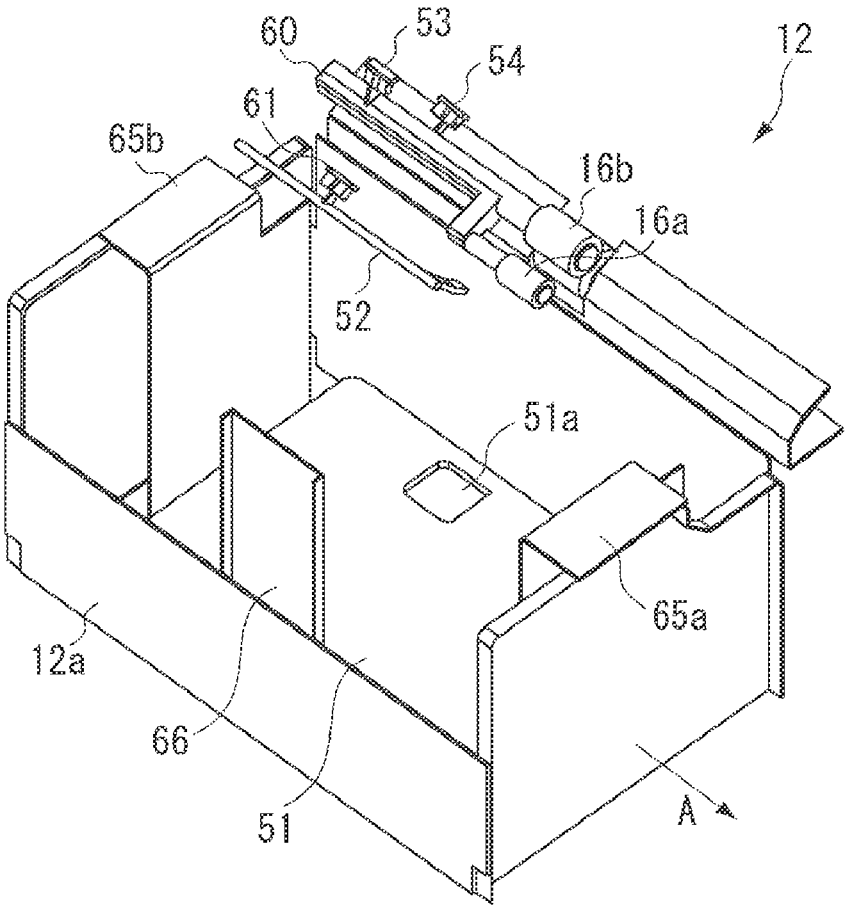
FIG. 2 is a perspective view illustrating the sheet feeding apparatus illustrated in FIG. 1.

The configuration of the feeding deck 12 (sheet feeding apparatus) will be described below with reference to FIG. 2. The feeding deck 12 includes a deck unit 12*a*, which is a sheet storage unit supported unloadably in a direction of an arrow A from the sheet feeding apparatus body by a slide rail (not illustrated). Sheets are stacked in the deck unit 12*a*. The tray 51 for stacking a bundle of sheets S is provided in the deck unit 12*a* so as to be vertically moved by an elevating mechanism 67 (illustrated in FIG. 8).

The position of the bundle of sheets S stacked on the tray 51 is regulated by the side regulating members 65*a* and 65*b* disposed on both sides and the trailing edge regulating member 66 disposed on the sheet trailing edge side. The side regulating members 65*a* and 65*b* and the trailing edge regulating member 66 are slidably supported. The position of various sheet sizes can be regulated by sliding these regulating members according to the size of sheets S to be stacked.

To maintain the position of the top surface of the sheet S stacked on the tray 51 to an appropriate range of height at which the pickup roller 16*a* can feed the sheet S, the feeding deck 12 (sheet storage unit) includes a sheet surface detection unit for detecting the position of the sheet top surface. The configuration of the sheet surface detection unit will be described below.

The pickup roller 16*a* (sheet feeding unit) for contacting the sheet top surface to feed the sheet is rotatably supported by the holder 60. The holder 60 is provided with flags for generating the ON/OFF signal of the sheet surface detection sensors 53 and 54 disposed in the vicinity of the holder 60. More specifically, when the pickup roller 16*a* is raised by the top surface of the sheet S stacked on the tray 51, the detection lever 60 rotates and the flags of the holder 60 interrupt and transmit light from the optical sheet surface detection sensors 53 and 54. The holder 60 and the sheet surface detection sensors 53 and 54 constitute the sheet surface detection unit in this way.

The feeding deck 12 (sheet feeding apparatus) also includes a sheet presence detection unit for detecting the presence of the sheet stacked on the tray 51. The configuration of the sheet presence detection unit will be described below.

The sheet presence detection unit includes a detection lever 52, which is rotatable and is provided with a flag. When the detection lever 52 rotates, the ON/OFF signal of the sheet presence detection sensor 61 is generated as the flag interrupts and transmits light from the optical sheet presence detection sensor 61. An opening 51*a* is formed on the tray 51. When no sheet S is present on the tray 51, the detection lever 52 falls into the opening 51*a*.

Figure 8:
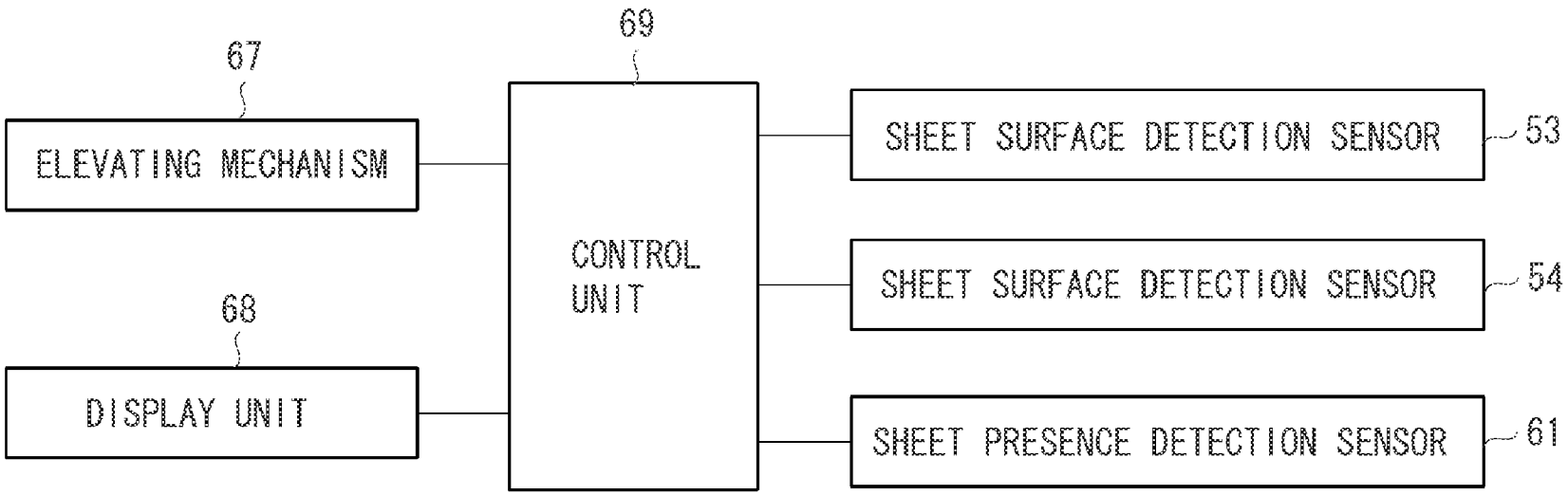
FIG. 8 is a block diagram illustrating a configuration for controlling sheet feeding.

FIG. 8 is a block diagram illustrating a configuration for controlling the feeding deck 12. A control unit 69 is connected with the elevating mechanism 67, the display unit 68, the sheet surface detection sensors 53 and 54, and the sheet presence detection sensor 61. The control unit 69 controls the elevating mechanism 67 and displays control statuses on the display unit 68 based on detection signals from the sheet surface detection sensors 53 and 54 and the sheet presence detection sensor 61.

Figure 6:
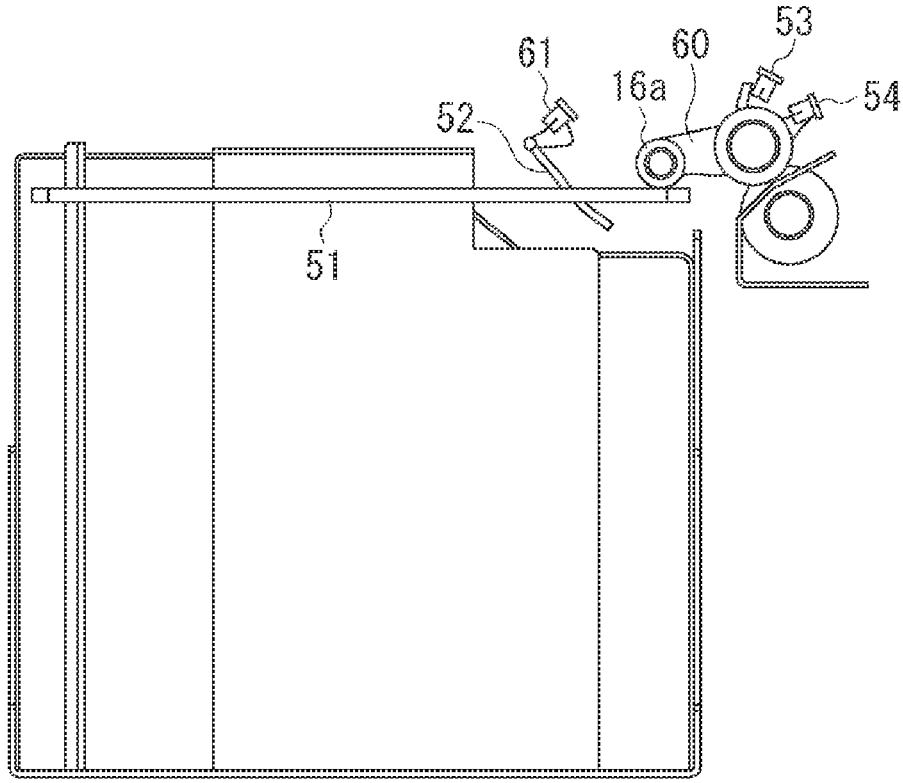
FIG. 6 illustrates a state where a sheet top surface is detected.
Figure 7:
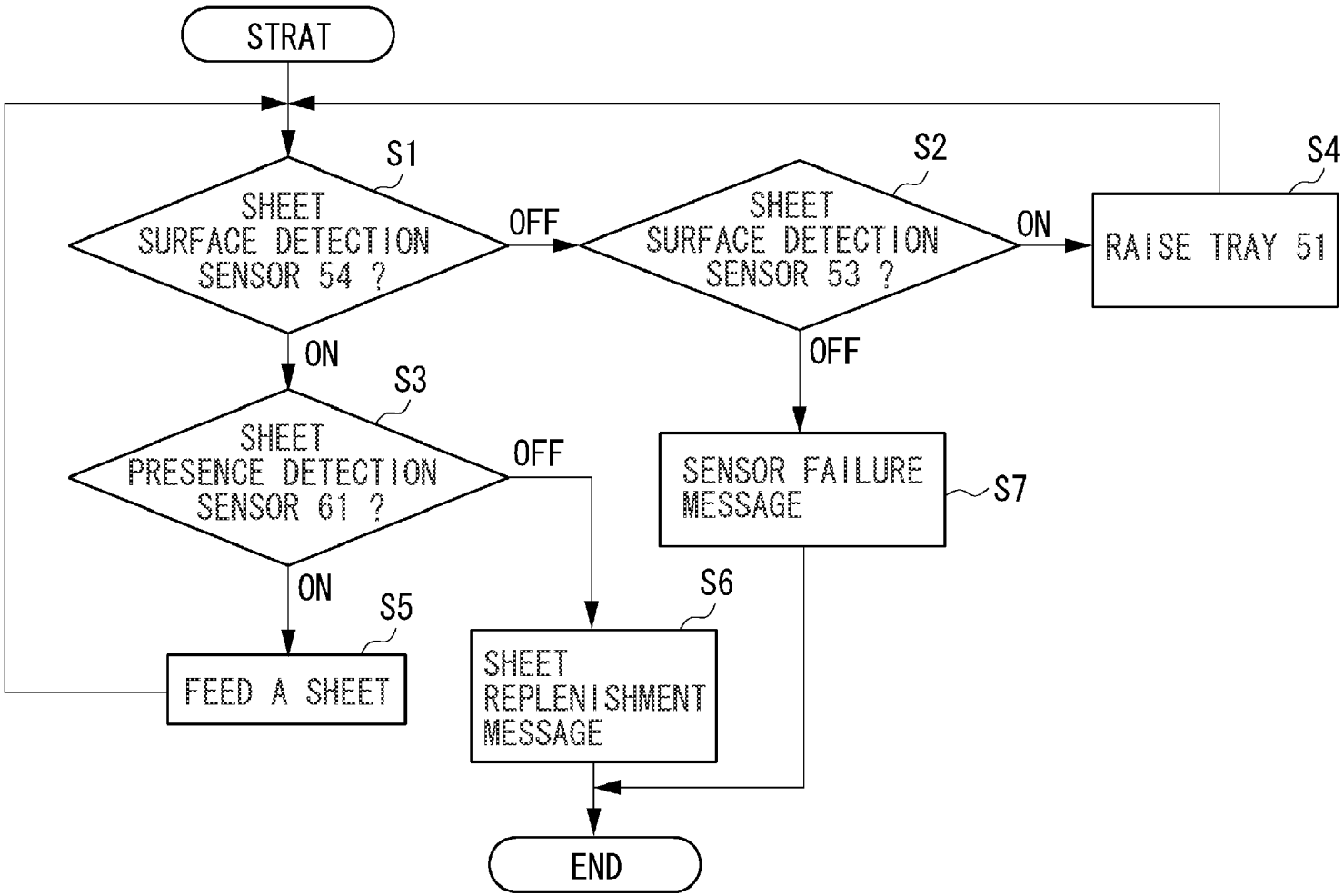
FIG. 7 is a flowchart illustrating sheet feeding from the sheet feeding apparatus.

The sheet detection operation and vertical tray moving operation in the feeding deck 12 will be described below with reference to the sectional views in FIGS. 4A and 4B, 5A and 5B, and 6, and the flow chart in FIG. 7. Hereinafter, each of the sheet surface detection sensors 53 and 54 and the sheet presence detection sensor 61 outputs an OFF detection signal when light is interrupted or the ON detection signal when light is transmitted.

Figure 4A:
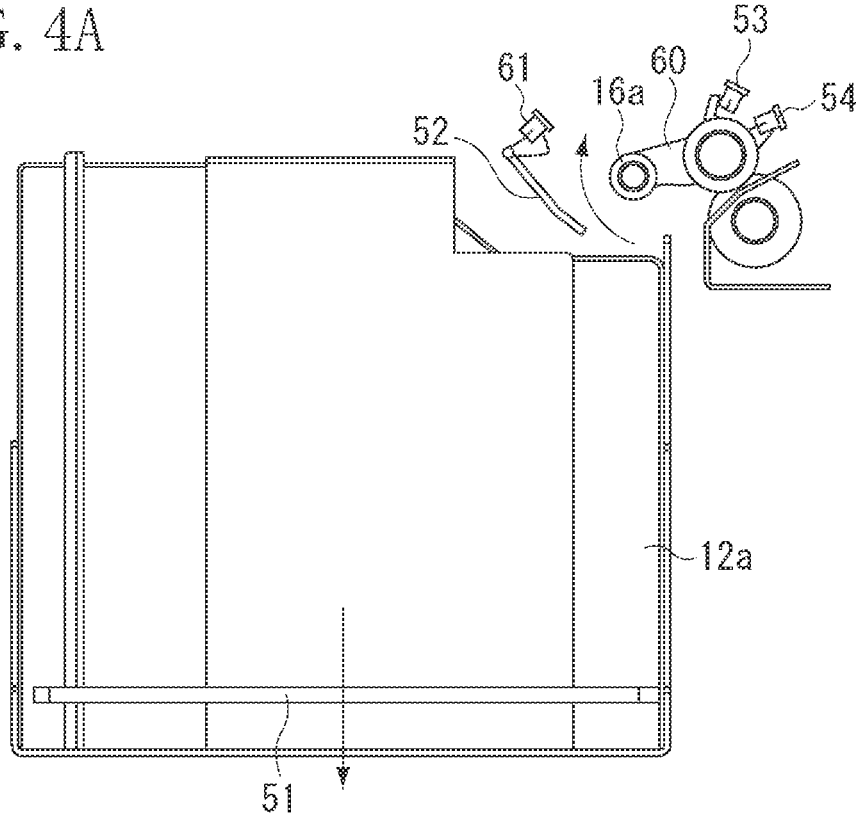
FIGS. 4A and 4B illustrate a state where sheets are stacked in the sheet feeding apparatus.
Figure 4B:
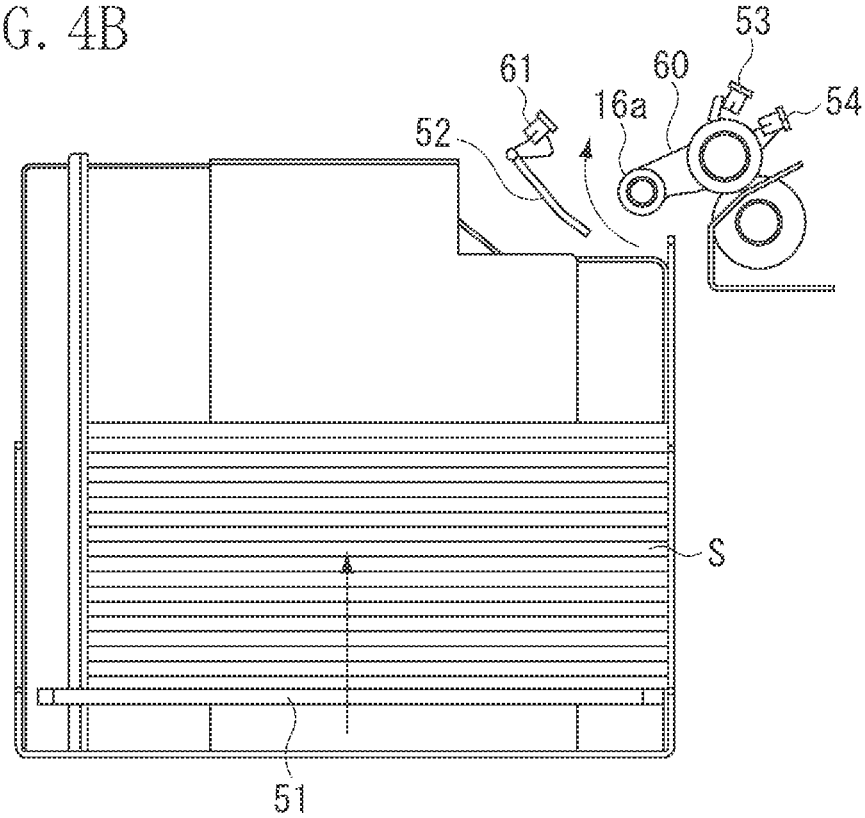

When the user unloads the deck unit 12*a* of the feeding deck 12 from the sheet feeding apparatus body, the tray 51 moves downward to the bottom of the deck unit 12*a*, as illustrated in FIG. 4A. Further, at the same time when the user unloads the deck unit 12*a*, a retracting mechanism (not illustrated) rotates the pickup roller 16*a* clockwise and then retracts it from the sheet top surface. This operation is performed to prevent the pickup roller 16*a* from colliding with the deck unit 12*a* when the user unloads the deck unit 12*a*. When a bundle of sheets S is stacked on the tray 51 and the deck unit 12*a* is loaded into the sheet feeding apparatus body as illustrated in FIG. 4B, the retracting mechanism releases the pickup roller 16*a* from the retracting state and then rotates it counterclockwise to set it at a predetermined position. Referring to the flow chart in FIG. 7, in step S1, the control unit 69 determines the sheet position based on the detection signal from the sheet surface detection sensor 54. When the feeding deck 12 is loaded into the sheet feeding apparatus body, the flag of the detection lever 60 interrupts light from the sheet surface detection sensor 54, and the sheet surface detection sensor 54 thus outputs an OFF signal. In this case (OFF in step S1), the processing proceeds to step S2. In this state, the control unit 69 determines that the sheet top surface is not positioned at a predetermined range of height.

The sheet surface detection sensor 53 is an upper-limit sensor for stopping the tray 51 when it cannot stop at an appropriate position or keeps moving upward because of incorrect detection or failure of the sheet surface detection sensor 54. In the normal state, the light of the sheet surface detection sensor 53 is not interrupted by the flag of the holder 60 and, therefore, the sheet surface detection sensor 53 keeps outputting the ON signal.

When the light from the sheet surface detection sensor 53 is transmitted and the ON signal is output (ON in step S2), the control unit 69 determines that the sheet surface detection sensor 54 is normal, and the processing proceeds to step S4. In step S4, the control unit 69 controls the elevating mechanism 67 to raise the tray 51. Then, the processing returns from step S4 to step S1. In step S1, the control unit 69 checks the signal from the sheet surface detection sensor 54.

When the sheet surface detection sensor 53 outputs the OFF signal (OFF in step S2), the control unit 69 determines a failure of either one or both of the sheet surface detection sensors 53 and 54. In step S7, the control unit 69 instructs the display unit 68 to display a message notifying a failure of either one or both of the sheet surface detection sensors 53 and 54. If the sheet surface detection sensor 53 does not detect the sheet surface, the tray 51 may keep moving upward, thus resulting in a failure of the feeding deck 12.

Figure 5A:
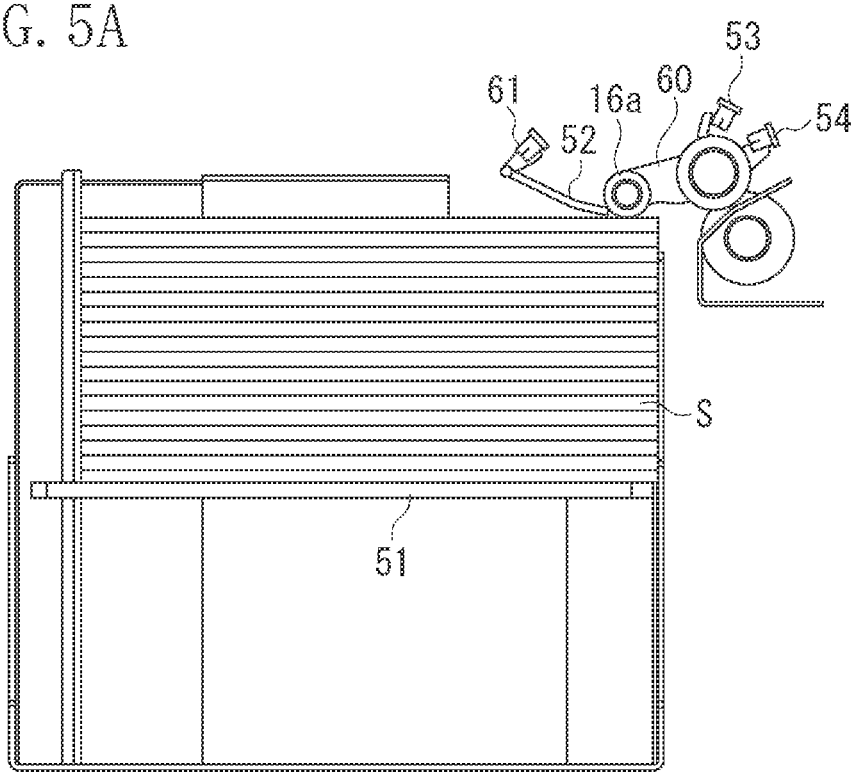
FIGS. 5A and 5B illustrate a state where a tray of the sheet feeding apparatus is raised with sheets stacked therein.

When the sheet surface detection sensors 53 and 54 are normally operating, the tray 51 moves upward and the sheet S top surface comes to a predetermined range of height at which the pickup roller 16*a* can feed the sheet S, as illustrated in FIG. 5A. Then, in step S1, the sheet surface detection sensor 54 outputs the ON signal.

Figure 5B:
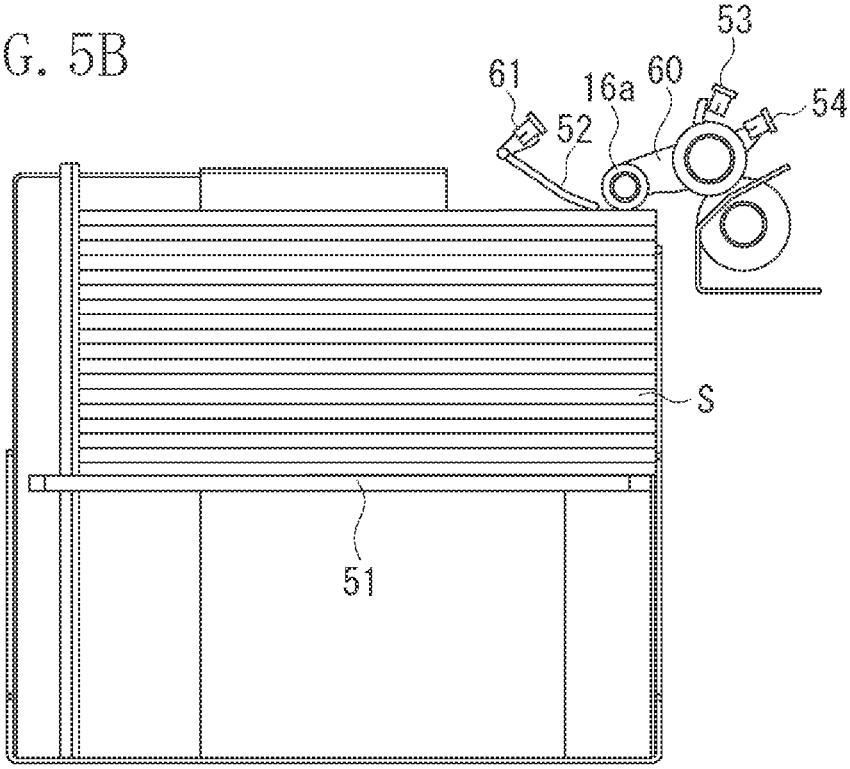

When the sheet surface detection sensor 54 outputs the ON signal (ON in step S1), the processing proceeds to step S3. When the sheet presence detection sensor 61 detects the presence of the sheet S and outputs the ON signal (ON in step S3), the control unit 69 determines that the sheet S is present in the feeding deck 12, and the processing proceeds to step S5. In step S5, the control unit 69 performs the sheet feed operation. When the printer 1 starts a print operation and sheet feeding is continued, the number of sheets S in the feeding deck 12 decreases and, as illustrated in FIG. 5B, the sheet surface detection sensor 54 outputs the OFF signal. In response to the OFF signal (OFF in step S1), the processing proceeds to step S2. In step S2, the control unit 69 controls the vertical motion of the tray 51. Subsequently, when moving upward of the tray 51 and feeding of the sheet S are repeated, the sheet S on the tray 51 runs out. In this case, the detection lever 52 falls into the opening 51*a* on the tray 51, as illustrated in FIG. 6. In step S5, the sheet presence detection sensor 61 outputs the OFF signal. In step S6, in response to this signal, the control unit 69 instructs the display unit 68 to display a message "Replenish sheets." Thus, the user unloads the deck unit 12*a* and then supplies sheets on the tray 51.

Figure 1:
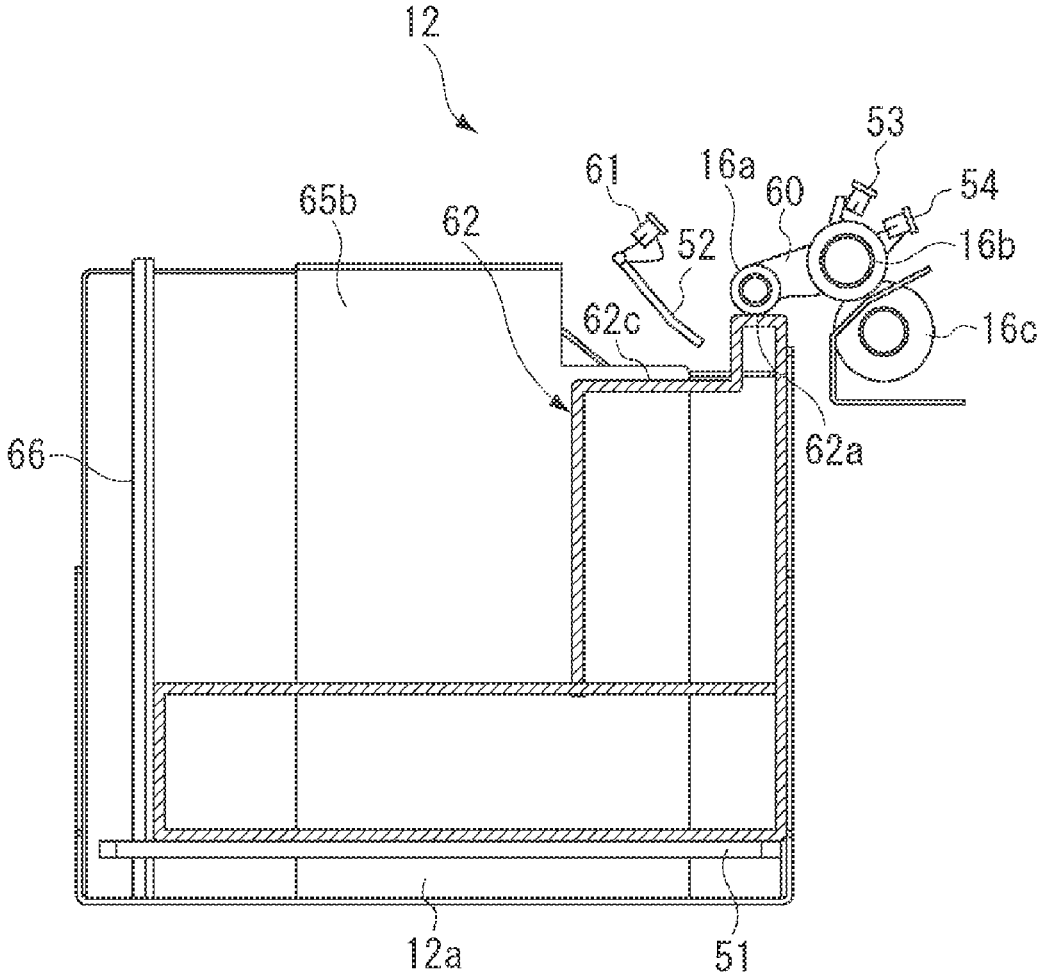
FIG. 1 is a schematic plan view illustrating a sheet feeding apparatus having a packing material attached therein according to a first exemplary embodiment of the present invention.

A packing material 62 will be described below. In the feeding deck 12, the tray 51 is suspended by a wire (not illustrated). The motor (not illustrated) of the elevating mechanism 67 winds and rewinds the wire to vertically move the tray 51. To prevent the tray 51 from being shaken by vibration during transportation of the feeding deck 12, the packing material 62 according to the first exemplary embodiment illustrated in FIG. 1 is attached in the deck unit 12*a*. The packing material 62 is fit so as to contact the side regulating members 65*a* and 65*b*, the trailing edge regulating member 66, and the tray 51, and fixed to each regulating member with an adhesive tape.

The packing material 62 has a contact surface 62*a* formed thereon for contacting the pickup roller 16*a* (sheet feeding unit). The height of the contact surface 62*a* is set to a height at which the light from the sheet surface detection sensor 54 is interrupted. Therefore, when the packing material 62 remains in the deck unit 12*a*, the sheet surface detection sensor 54 outputs the ON signal and, therefore, the control unit 69 does not control the elevating mechanism 67 to raise the tray 51. Since a level difference 62*c* is formed on the top surface of the packing material 62 to prevent contact with the detection lever 52 of the sheet presence detection sensor 61, the sheet presence detection sensor 61 outputs the OFF signal. Therefore, the control unit 69 determines that no sheet is present on the tray 51 and instructs the display unit 68 to display a prompt message "Replenish sheets."

In response to this message, the user unloads the deck unit 12*a* of the feeding deck 12 to supply sheets S. At this timing, the user can notice that the packing material 62 has not yet been removed. Thus, the packing material 62 can be removed and sheets S can be supplied to the tray 51. With this simple configuration, a failure to remove the packing material 62 from the feeding deck 12 can be prevented simply by changing the shape of the packing material 62 without using a dedicated sensor, thus preventing damage to the sheet feeding apparatus.

Figure 9A:
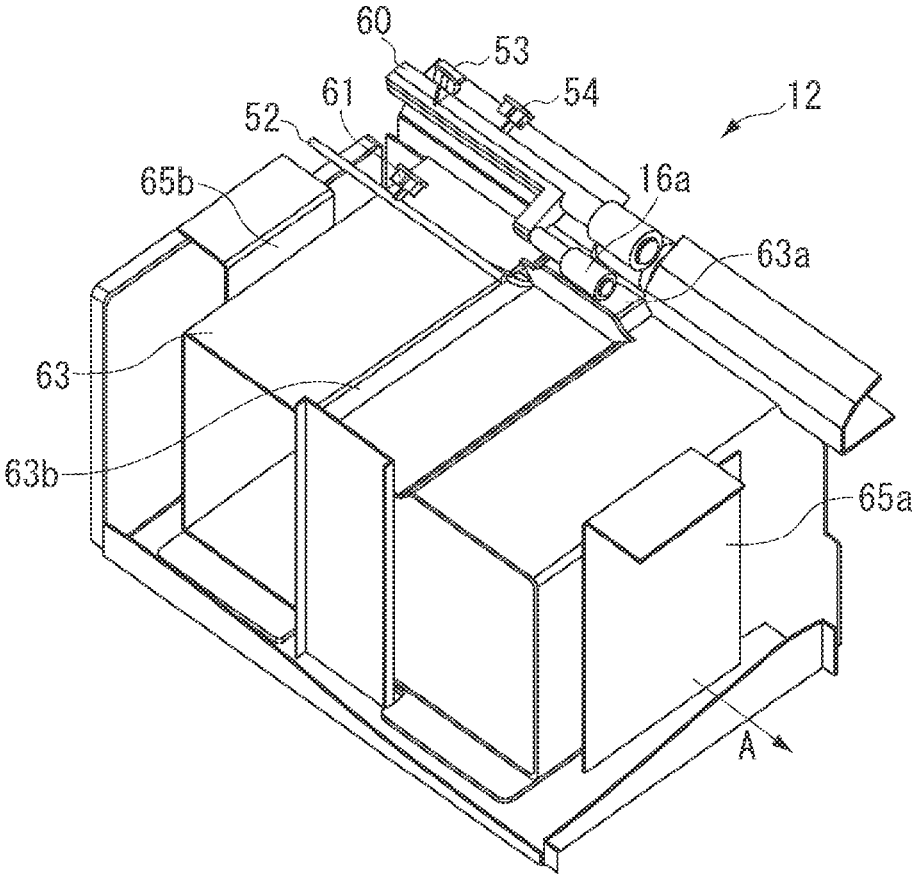
FIGS. 9A and 9B illustrate a sheet feeding apparatus having a packing material attached therein according to a second exemplary embodiment of the present invention.
Figure 9B:
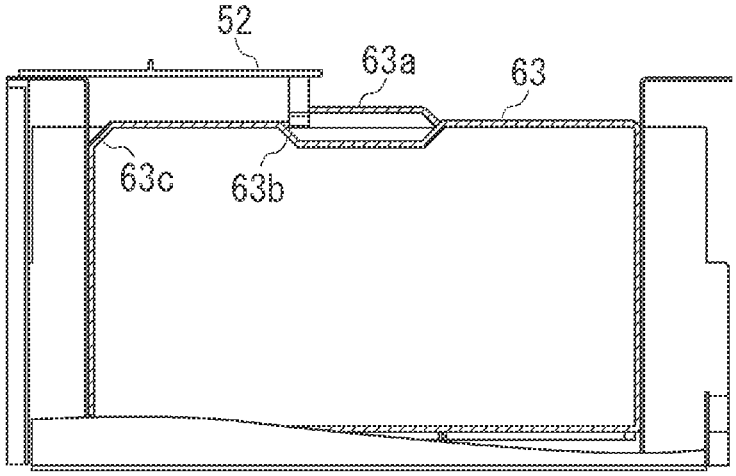
Figure 10A:
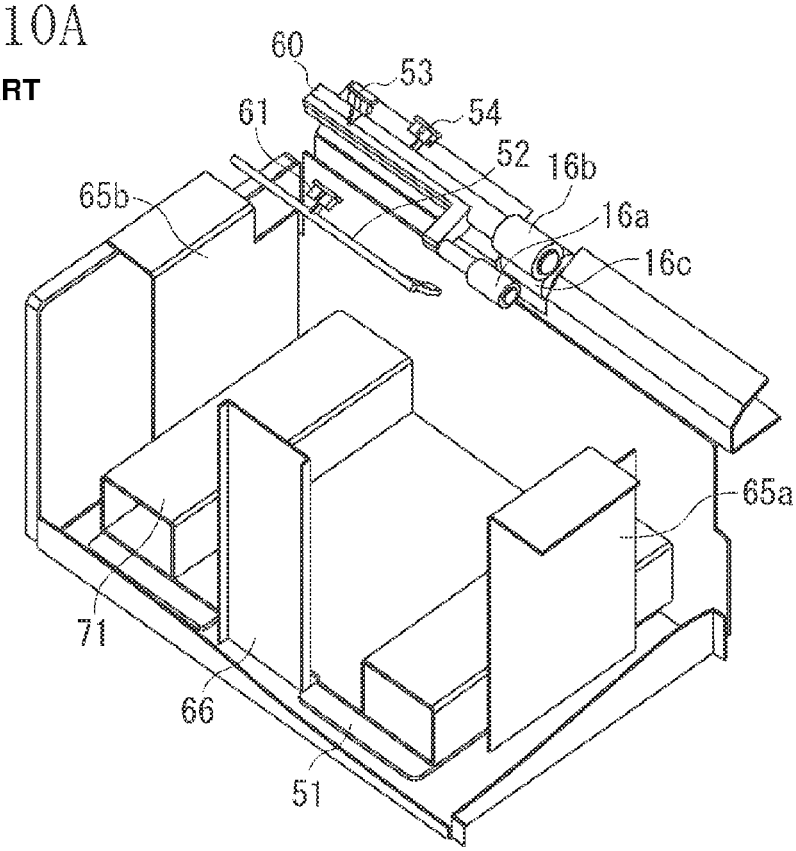
FIG. 10A PRIOR ART
FIGS. 10A and 10B are perspective views illustrating an exemplary conventional packing material.
Figure 10B:
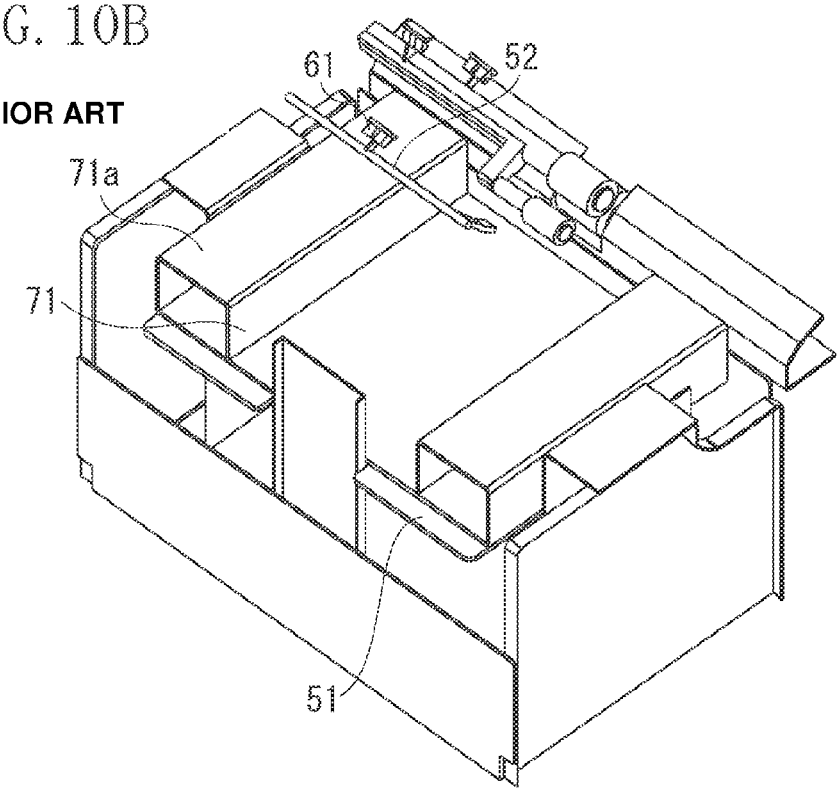
FIG. 10B PRIOR ART
Figure 11A:
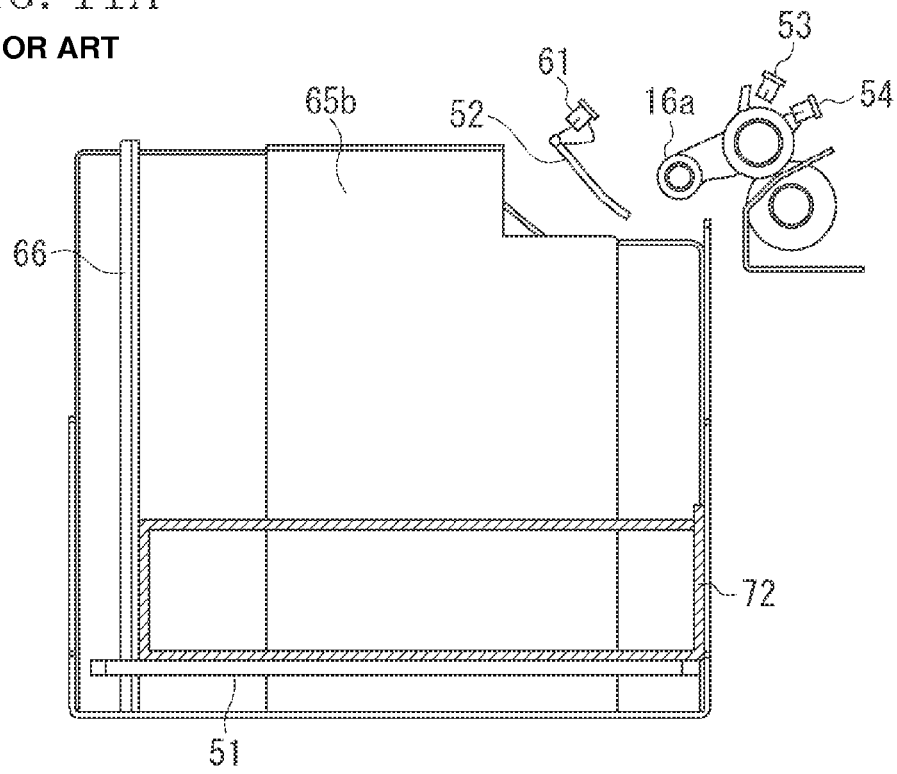
FIG. 11A PRIOR ART
FIGS. 11A and 11B are side views illustrating another exemplary conventional packing material.
Figure 11B:
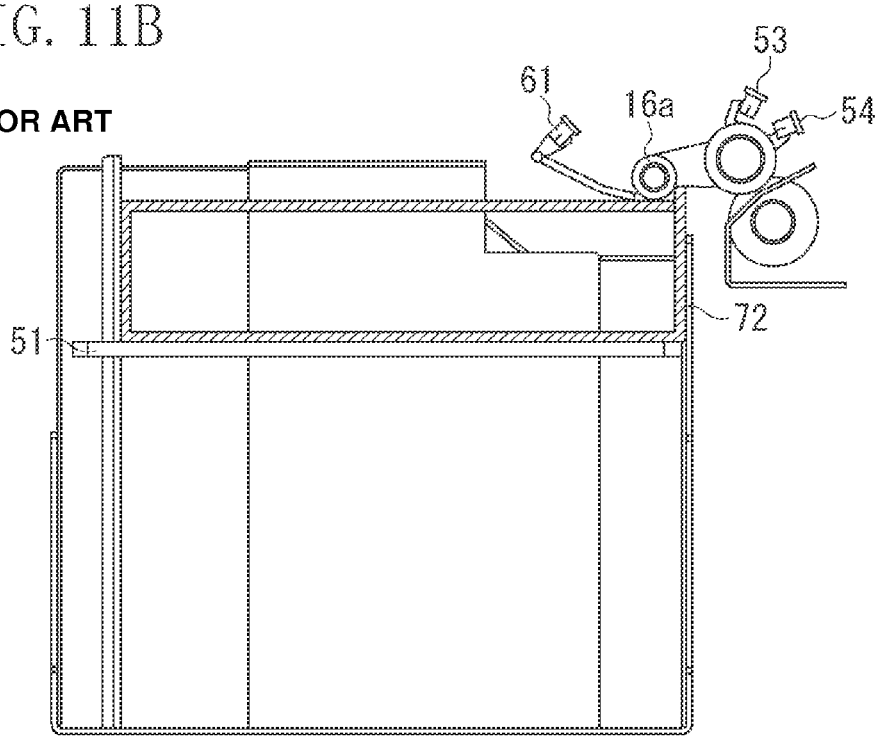
FIG. 11B PRIOR ART

A second exemplary embodiment of the present invention will be described below with reference to FIGS. 9A and 9B. The second exemplary embodiment will be described in detail below based on differences from the first exemplary embodiment. Descriptions of similar configurations to the first exemplary embodiment will be omitted.

A packing material 63 according to the present exemplary embodiment is attached so as to contact the side regulating members 65*a* and 65*b*, the trailing edge regulating member 66, and the tray 51 in the deck unit 12*a*. The packing material 63 is fixed to each member with an adhesive tape. Further, the packing material 63 has a contact surface 63*a* formed thereon for contacting the pickup roller 16*a* when the packing material 63 is attached in the deck unit 12*a*. The height of the contact surface 63*a* is set to a height at which the light from the sheet surface detection sensor 54 is interrupted by the flag of the holder 60 for the pickup roller 16*a*. Therefore, when the packing material 63 remains in the deck unit 12*a*, the sheet surface detection sensor 54 outputs the ON signal and, therefore, the control unit 69 does not raise the tray 51.

The position 63*a* on the packing material 63 facing the detection lever 52 of the sheet presence detection sensor 61 has a concave shape having a taper portion 63*b*. Therefore, since the detection lever 52 does not come in contact with anywhere, the sheet presence detection sensor 61 is in the light transmission state and outputs the OFF signal. Therefore, the control unit 69 determines that no sheet is stacked on the tray 51 and instructs the display unit 68 to display a prompt message "Replenish sheets."

In response to this message, the user unloads the deck unit 12*a* of the feeding deck 12 to supply the sheets S. At this timing, the user can notice that the packing material 63 has not yet been removed. Thus, the packing material 63 can be removed and the sheets S can be supplied to the tray 51. With this simple configuration, a failure to remove the packing material 63 from the feeding deck 12 can be prevented simply by changing the shape of the packing material 63, thus preventing damage to the sheet feeding apparatus.

The taper surface 63*b* is formed on the side of the concave portion of the packing material 63, and a taper surface 63*c* is formed at the top of the front side in the loading direction of the packing material 63. Therefore, when the user unloads or loads the deck unit 12*a*, the detection lever 52 is raised while being guided by the taper surfaces 63*b* and 63*c*, thus preventing damage to or deformation of the detection lever 52.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-281004 filed Dec. 10, 2009, which is hereby incorporated by reference herein in its entirety.

What is claimed is:

1. A sheet feeding apparatus comprising:

a sheet storage unit configured to store sheets;

an elevatable tray disposed in the sheet storage unit to supply sheets stacked thereon;

a sheet feeding unit configured to feed a sheet stacked on the tray;

a sheet surface detection unit configured to output a signal for detecting a top surface position of the sheets stacked on the tray;

a sheet presence detection unit configured to output a signal for detecting a presence of a sheet on the tray;

a control unit configured to control the tray; and a packing material attached in the sheet storage unit to fix the tray, wherein the packing material is formed in such a shape that, when the packing material is attached in the sheet storage unit, the control unit determines that no sheet is present on the tray based on detection signals from the sheet surface detection unit and the sheet presence detection unit.

2. The sheet feeding apparatus according to claim 1, wherein the packing material is formed in such a shape that, when the packing material is fixed on the tray, the packing material contacts the sheet surface detection unit but does not contact the sheet presence detection unit.

3. The sheet feeding apparatus according to claim 1, wherein the packing material is formed in such a shape that the sheet surface detection unit outputs a detection signal when the top surface of the sheets stacked on the tray is within a predetermined range of height, and the sheet presence detection unit outputs a detection signal when no sheet is present on the tray.

4. The sheet feeding apparatus according to claim 1, wherein the sheet storage unit is disposed to be unloadable from a body of the sheet feeding apparatus, and wherein the packing material has a taper for guiding the sheet surface detection unit or the sheet presence detection unit when the sheet storage unit is unloaded.

5. An image forming apparatus for forming, by an image forming unit, an image on a sheet fed from a sheet feeding apparatus, the image forming apparatus comprising:

a sheet storage unit configured to store sheets;

an elevatable tray disposed in the sheet storage unit to supply sheets stacked thereon;

a sheet feeding unit configured to feed a sheet stacked on the tray;

a sheet surface detection unit configured to output a signal for detecting a top surface position of the sheets stacked on the tray;

a sheet presence detection unit configured to output a signal for detecting a presence of a sheet on the tray;

a control unit configured to control the tray; and a packing material attached in the sheet storage unit to fix the tray, wherein the packing material is formed in such a shape that, when the packing material is attached in the sheet storage unit, the control unit determines that no sheet is present on the tray based on detection signals from the sheet surface detection unit and the sheet presence detection unit.

6. The image forming apparatus according to claim 5, wherein the packing material is formed in such a shape that, when the packing material is fixed on the tray, the packing material contacts the sheet surface detection unit but does not contact the sheet presence detection unit.

7. The image forming apparatus according to claim 5, wherein the packing material is formed in such a shape that the sheet surface detection unit outputs a detection signal when the top surface of the sheets stacked on the tray is within a predetermined range of height, and the sheet presence detection unit outputs a detection signal when no sheet is present on the tray.

8. The image forming apparatus according to claim 5, wherein the sheet storage unit is disposed to be unloadable from a body of the sheet feeding apparatus, and wherein the packing material has a taper for guiding the sheet surface detection unit or the sheet presence detection unit when the sheet storage unit is unloaded.

9. The image forming apparatus according to claim 5, further comprising a display unit mounted on a body of the image forming apparatus, and wherein, when the control unit determines that no sheet is present on the tray, the control unit instructs the display unit to display a message prompting replenishment of sheets on the tray.

* * * * *